US009387970B2

(12) United States Patent
Cheong et al.

(10) Patent No.: US 9,387,970 B2
(45) Date of Patent: Jul. 12, 2016

(54) CONTAINER STRUCTURE

(75) Inventors: Tae Hong Cheong, Seoul (KR); Gu Hoan Cha, Seoul (KR); Kyoung Sik Jo, Seoul (KR); Ki Min Rhyu, Seoul (KR)

(73) Assignee: CJ Cheiljedang Corp., Seoul (KR)

( * ) Notice: Subject to any disclaimer, the term of this patent is extended or adjusted under 35 U.S.C. 154(b) by 0 days.

(21) Appl. No.: 13/394,103

(22) PCT Filed: Oct. 27, 2010

(86) PCT No.: PCT/KR2010/007432

§ 371 (c)(1),
(2), (4) Date: Mar. 2, 2012

(87) PCT Pub. No.: WO2011/052997

PCT Pub. Date: May 5, 2011

(65) Prior Publication Data

US 2012/0152952 A1 Jun. 21, 2012

(30) Foreign Application Priority Data

Oct. 28, 2009 (KR) ..... 10-2009-0102720

(51) Int. Cl.
*B65D 51/18* (2006.01)
*B65D 41/00* (2006.01)
*B65D 77/20* (2006.01)

(52) U.S. Cl.
CPC ..... *B65D 77/208* (2013.01); *B65D 51/185* (2013.01); *B65D 77/2024* (2013.01); *B65D 2203/00* (2013.01)

(58) Field of Classification Search
CPC ..... B65D 5/56; B65D 5/64; B65D 51/20; B65D 85/72; B65D 51/16; B65D 17/34; B65D 81/20; B65D 85/60; B65D 77/208; B65D 2203/00; A47G 19/26; A47G 19/265
USPC ..... 215/232; 220/359.1, 359.4, 359.3, 801; 426/106, 112, 115, 128, 130
See application file for complete search history.

(56) References Cited

U.S. PATENT DOCUMENTS 2,157,794 A * 5/1939 MacDonald et al. ..... 156/211
2,985,075 A * 5/1961 Knutsson-Hall ..... 493/274

(Continued)

FOREIGN PATENT DOCUMENTS

CN 1146966 A 4/1997
CN 1155870 A 7/1997

(Continued)

OTHER PUBLICATIONS

International Search Report, dated Jun. 28, 2011, corresponding to PCT/KR2010/007432.

(Continued)

*Primary Examiner* — Nathan J Newhouse
*Assistant Examiner* — Jennifer N Zettl
(74) *Attorney, Agent, or Firm* — Lewis Roca Rothgerber Christie LLP

(57) ABSTRACT

A container structure having a sealing cap that is heat-sealed on a lid film. In the container structure, a locking rib that can be locked and unlocked to the locking unit is formed on an edge of the sealing cap, and the container includes a lid film that is thermally attached to an upper surface of the sealing cap and an edge of which protrudes outwards from the edge of the sealing cap, and the edge of the lid film is heat-sealed onto the flange of the container.

2 Claims, 3 Drawing Sheets

(56) References Cited

U.S. PATENT DOCUMENTS

| | | | | | |
|---|---|---|---|---|---|
| 3,033,434 | A * | 5/1962 | Carson | 229/406 |
| 3,079,037 | A * | 2/1963 | Schechter | 220/212 |
| 3,561,668 | A * | 2/1971 | Bergstrom | 229/123.1 |
| 3,654,053 | A * | 4/1972 | Toedter | 428/56 |
| 3,943,022 | A * | 3/1976 | Susnjara | 156/211 |
| 3,946,872 | A * | 3/1976 | Sturm | 220/359.3 |
| 4,142,931 | A * | 3/1979 | Viol et al. | 156/257 |
| 4,913,307 | A | 4/1990 | Takata et al. | |
| 5,129,517 | A * | 7/1992 | Hustad | 206/467 |
| 5,582,317 | A * | 12/1996 | Wermund | 220/789 |
| 6,193,094 | B1 * | 2/2001 | Diamond et al. | 220/254.1 |
| 6,395,318 | B1 * | 5/2002 | Sumpmann et al. | 426/115 |
| 6,688,486 | B2 * | 2/2004 | Diamond et al. | 220/785 |
| 6,802,422 | B2 * | 10/2004 | Kalvelage et al. | 206/538 |
| 6,939,513 | B2 * | 9/2005 | Berray et al. | 422/569 |
| 7,055,713 | B2 * | 6/2006 | Rea et al. | 220/276 |
| 7,549,540 | B2 * | 6/2009 | Lee et al. | 206/519 |
| 7,997,044 | B2 * | 8/2011 | Green et al. | 52/834 |
| D658,187 | S * | 4/2012 | Diebel | D14/440 |
| D658,188 | S * | 4/2012 | Diebel | D14/440 |
| D663,304 | S * | 7/2012 | Akana et al. | D14/440 |
| 8,264,310 | B2 * | 9/2012 | Lauder et al. | 335/219 |
| 8,376,181 | B2 * | 2/2013 | Lundgreen et al. | 220/805 |
| 8,395,465 | B2 * | 3/2013 | Lauder et al. | 335/219 |
| 2002/0070218 | A1 * | 6/2002 | Mozes | B65D 43/161 220/254.3 |
| 2006/0049073 | A1 * | 3/2006 | Shannon | B65D 77/2016 206/459.5 |
| 2012/0031799 | A1 * | 2/2012 | Cha et al. | 206/524.1 |
| 2012/0268891 | A1 * | 10/2012 | Cencioni | 361/679.55 |

FOREIGN PATENT DOCUMENTS

| | | | |
|---|---|---|---|
| DE | 25 34 748 | | 2/1977 |
| DE | 10-2006-031 292 | A1 | 1/2008 |
| EP | 0 665 171 | A1 | 8/1995 |
| EP | 0741087 | A1 | 11/1996 |
| EP | 0760343 | A1 | 3/1997 |
| JP | 6-33110 | | 4/1988 |
| JP | 6-33110 | | 5/1994 |
| JP | 2001-010667 | | 1/2001 |
| JP | 2002-104537 | | 4/2002 |
| JP | 2004-196308 | A | 7/2004 |
| KR | 10-2005-0051490 | A | 6/2005 |
| KR | 20-2008-0006299 | | 12/2008 |
| KR | 10-2009-0080798 | | 7/2009 |
| KR | 10-2009-0080798 | A | 7/2009 |
| WO | WO 01/09002 | | 2/2001 |
| WO | WO 01/09002 | A2 | 2/2001 |
| WO | WO 2007/071252 | A1 | 6/2007 |

OTHER PUBLICATIONS

Australian Office Action dated Aug. 13, 2013 of Australian Patent Application No. 2010314025 which is based on PCT Application No. PCT/KR2010/007432 and also claims priority of the corresponding Korean Application No. 10-2009-0102720, noting listed references in this IDS (3 pages).

Chinese Office action dated Dec. 2, 2013 for Chinese Patent Application No. 201080043457.0; which is based on PCT Application No. PCT/KR2010/007432 and also claims priority of the corresponding Korean priority application No. 10-2009-0102720, 8 pages.

Australian Office action dated May 15, 2014 for Australian Patent Application No. 2010314025, which is based on PCT Application No. PCT/KR2010/007432 and also claims priority of the corresponding Korean priority application No. 10-2009-0102720.

Japanese Office action dated Jun. 3, 2014 for Japanese Patent Application No. 2012-536675, which is based on PCT Application No. PCT/KR2010/007432 and also claims priority of the corresponding Korean priority application No. 10-2009-0102720.

* cited by examiner

CONTAINER STRUCTURE

CROSS-REFERENCE TO RELATED APPLICATION

This application is a National Phase Patent Application and claims the priority of International Application Number PCT/KR2010/007432, filed on Oct. 27, 2010, which claims priority of Korean Patent Application Number 10-2009-0102720, filed on Oct. 28, 2009.

TECHNICAL FIELD

The present invention relates to a container structure having a sealing cap thermally attached on a lid film, and more particularly, to a container structure having a sealing cap thermally attached to a lid film that can be opened and re-closed without damaging the lid film.

BACKGROUND ART

Generally, contents in a liquid or solid state, such as a red-pepper paste or ham, are distributed or circulated around in a sealed state in a container.

FIG. 1 is an exploded perspective view of a conventional sealing container. The conventional sealing container includes a container 10 in which a content is accommodated, a lid film 11 that is heat-sealed on upper edges of the container 10, and a lid 20 that is combined with be able to open and close the container 10.

When the conventional sealing container is used, the sealing state is released by removing the lid film 11 from the container 10. In most cases, when the lid film 11 having a film shape such as an aluminum thin film is removed from the container 10, the lid film 11 is damaged, and thus, the lid film 11 cannot be reused.

In this case, it is unnecessary to print an advertisement such as a trade mark on a surface of the lid film 11, thereby reducing the quality of service providing convenience to a customer.

Moreover, a portion of the damaged lid film 11 on upper edges of the container 10 remains in a heat-sealed state, the content attaches to the remaining lid film 11, and thus, contaminates the lid 20, thereby causing inconveniences in use.

In the conventional sealing container described above, after the lid film 11 is heat-sealed to the upper edges of the container 10, the lid film 11 is finally sealed by the lid 20. In this structure, when the lid film 11 is removed, a contamination such as a stain on the upper edges of the container 10 by the content may easily occur, and also, since the lid film 11 may easily tear, the lid film 11 cannot be re-used to prevent contamination.

Also, if the lid 20 is opened during circulation or production, the lid film 11 may be damaged, thereby producing product failures.

DISCLOSURE OF INVENTION

Technical Problem

To address the above and/or other problems, the present invention provides a container structure having a sealing cap thermally attached to a lid film that can be opened and re-closed without damaging the lid film.

The present invention also provides a container structure having a sealing cap thermally attached to a lid film that can be readily opened from a container.

The present invention also provides a container structure having a sealing cap thermally attached to a lid film that can form cutting guide protrusions on a content included in the container.

Solution to Problem

According to an aspect of the present invention, there is provided a container structure including: a container in which a content is contained, in which a flange extends outwards on an upper end, and in which a locking unit is formed on an inner circumference; and a sealing cap that is combined with the locking unit and seals the container to be able to be opened and closed, wherein a locking rib that can be locked and unlocked to and from the locking unit is formed on an edge of the sealing cap, the container structure further includes a lid film that is thermally attached to an upper surface of the sealing cap and an edge of which protrudes outwards from the edge of the sealing cap, and the edge of the lid film is heat-sealed onto the flange of the container.

The sealing cap may include long bending grooves on a lower surface thereof in a direction crossing the opening of the sealing cap.

In the container structure having a sealing cap thermally attached to a lid film according to the present invention, since the lid film and the sealing cap are thermally attached to each other, the lid film can be opened without causing damage, and accordingly, advertisements such as trademarks printed on the lid film can last for a long time, thereby providing user convenience.

Also, since bending grooves form cutting guide protrusions on an upper surface of the content to allow the content cutting in a predetermined size when the content is cut.

Advantageous Effects of Invention

In the container structure having the above-described structure, since the lid film 40 and the sealing cap 50 are thermally attached to each other, the lid film 40 can be opened without damaging. Accordingly, advertisements such as trademarks printed on the lid film 40 can last for a long time, thereby providing user convenience.

Also, since the bending grooves 51 are formed in the lower surface of the sealing cap 50, the sealing cap 50 can be smoothly opened. Also, the bending grooves 51 form the cutting guide protrusions 101 on the upper surface of the content 100 to guide cutting the content 100 in a predetermined size when the content 100 is cut.

BRIEF DESCRIPTION OF DRAWINGS

The above and other features and advantages of the present invention will become more apparent by describing in detail exemplary embodiments thereof with reference to the attached drawings in which.

BEST MODE FOR CARRYING OUT THE INVENTION

In a container structure according to the present invention, a lid film can be opened without being damaged, and thus, advertisements such as trademarks printed on the lid film can last for a long time, thereby providing user convenience.

Figure 1:
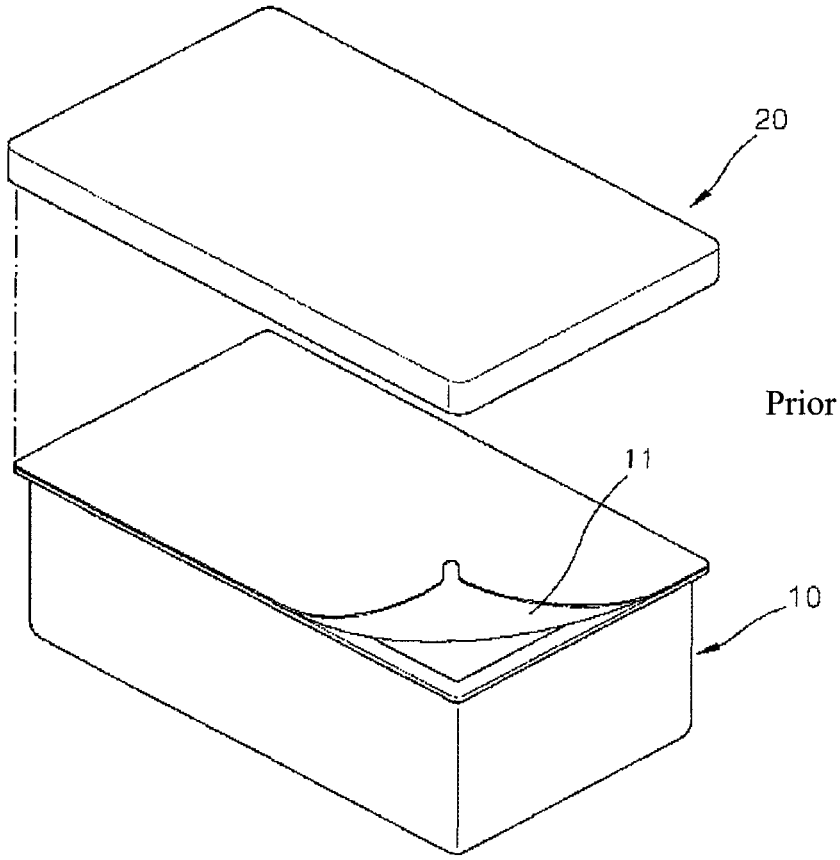
FIG. 1 is an exploded perspective view of a conventional sealing container.
Figure 2:
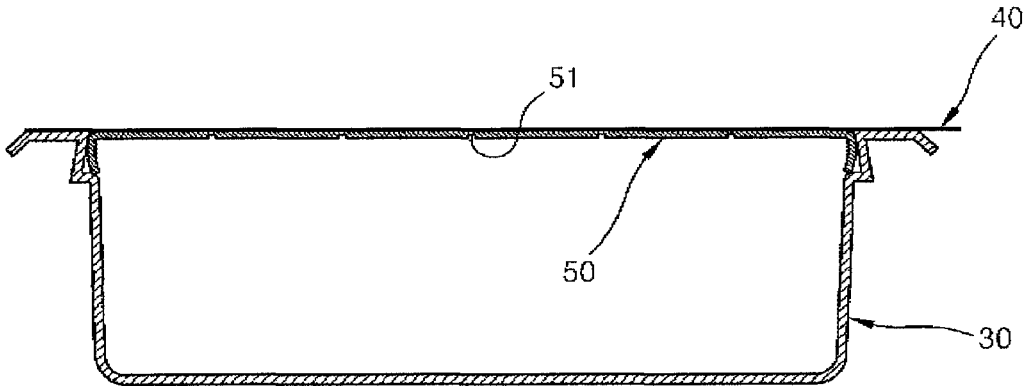
Prior Art Fig. 2
FIG. 2 is a cross-sectional view of a container structure according to an embodiment of the present invention.
Figure 3:
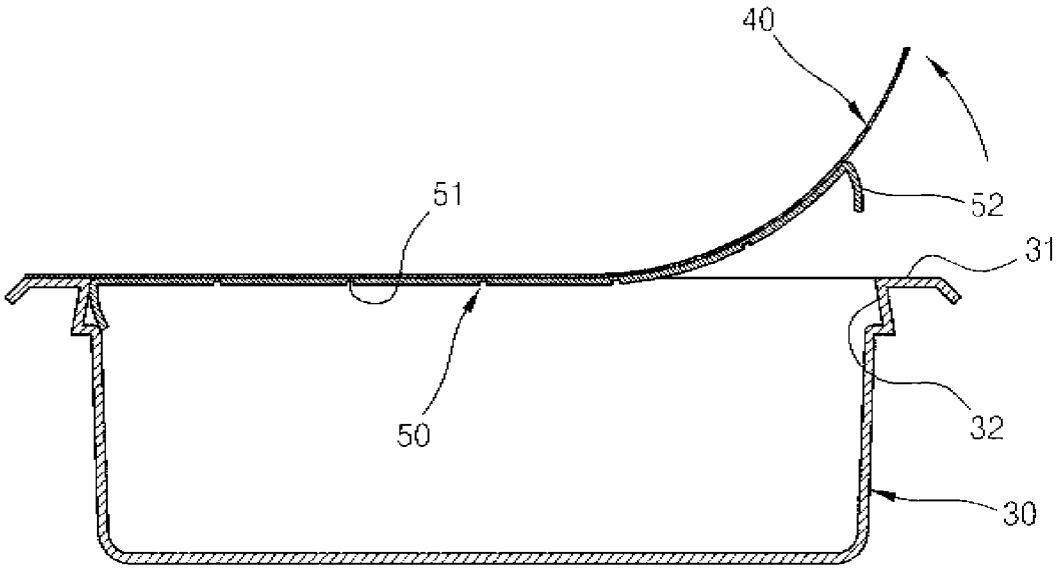
FIG. 3 is a cross-sectional view showing the opening of a sealing cap of the container structure of FIG. 2.
Figure 4:
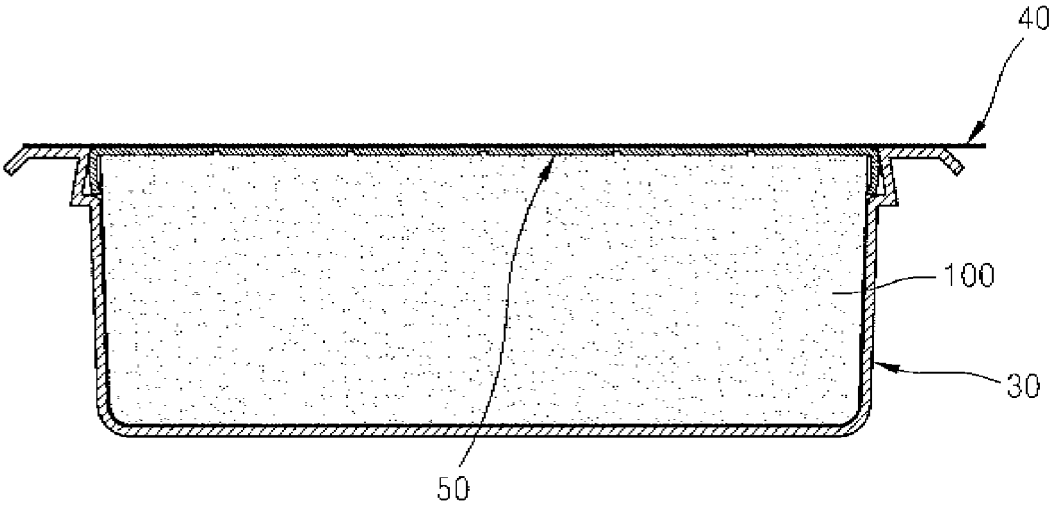
FIG. 4 is a cross-sectional view showing a content contained in a container structure.

FIG. 2 is a cross-sectional view of a container structure according to an embodiment of the present invention. FIG. 3 is a cross-sectional view showing the opening of a sealing cap 50 of the container structure of FIG. 2. FIG. 4 is a cross-sectional view showing a content 100 contained in the container structure. Referring to FIGS. 2 through 4, the container structure includes a container 30 in which the content 100 is contained, a flange 31 extends outwards on an upper end, and a locking unit 32 is formed on an inner circumference. The container structure also includes the sealing cap 50 that is combined with the locking unit 32 and seals the container 30 to be able to open and close.

A locking rib 52 that is lockable and unlockable to and from the locking unit 32 is formed on an edge of the sealing cap 50, and a lid film 40 that is thermally attached to the sealing cap 50 is formed on an upper surface of the sealing cap 50.

An edge of the lid film 40 thermally attached to the upper surface of the sealing cap 50 protrudes outwards from the edge of the sealing cap 50, that is, the lid film 40 is formed larger than the sealing cap 50, and thus, the edge of the lid film 40 is heat-sealed to the flange 31 of the container 30.

The combining force between the sealing cap 50 and the lid film 40 is greater than the combining force between the locking unit 32 and the locking rib 52. Therefore, when the locking force between the locking unit 32 and the locking rib 52 is released after realising the combining force between the lid film 40 and the flange 31, the removal of the lid film 40 from the sealing cap 50 is prevented.

Long bending grooves 51 are formed in a lower surface of the sealing cap 50 in a direction crossing the opening direction of the sealing cap 50. In this case, as shown in FIG. 3, when the sealing cap 50 is opened, the bending grooves 51 facilitate the bending of the sealing cap 50, thereby enabling smooth opening of the sealing cap 50.

Figure 5:
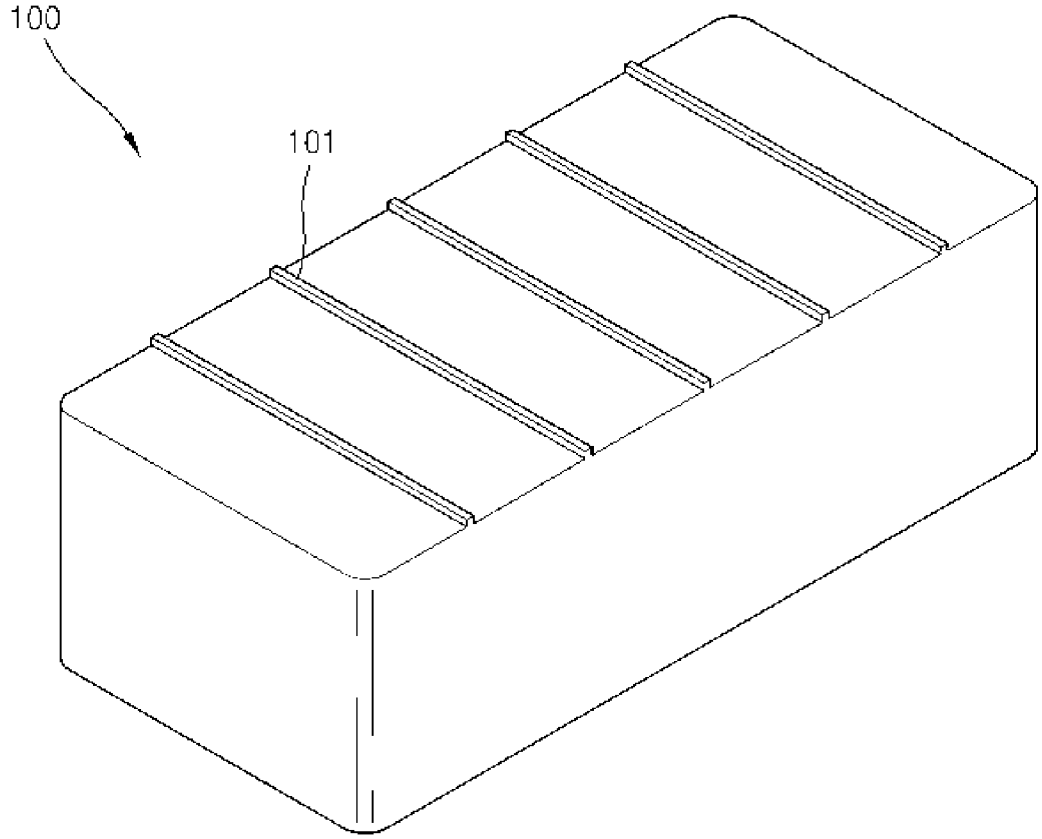
FIG. 5 is a perspective view showing a content contained in a container structure.

The bending grooves 51 formed in the lower surface of the sealing cap 50 form cutting guide protrusions 101 (refer to FIG. 5) on an upper surface of the content 100 contained in the container 30. The cutting guide protrusions 101 guide cutting the content 100 in a predetermined size when the content 100 is cut.

In the container structure having the above-described structure, in order to manufacture the sealing cap 50 having a re-sealable function, the sealing cap 50 is thermally bonded to the lid film 40 on a designated position of the lid film 40 using an indication mark. After forcedly inserting the locking rib 52 of the sealing cap 50 into the locking unit 32 of the container 30, the edge of the lid film 40 is heat-sealed onto the flange 31 of the container 30.

In order to prevent the sealing cap 50 from separating from the lid film 40 when the container 30 is opened, the lid film 40 and the sealing cap 50 are thermally attached to each other in advance, and afterwards, the sealing cap 50 is combined with the container 30, and finally, the edge of the lid film 40 is heat-sealed to the flange 31.

In the container structure having the above-described structure, since the lid film 40 and the sealing cap 50 are thermally attached to each other, the lid film 40 can be opened without damaging. Accordingly, advertisements such as trademarks printed on the lid film 40 can last for a long time, thereby providing user convenience.

Also, since the bending grooves 51 are formed in the lower surface of the sealing cap 50, the sealing cap 50 can be smoothly opened. Also, the bending grooves 51 form the cutting guide protrusions 101 on the upper surface of the content 100 to guide cutting the content 100 in a predetermined size when the content 100 is cut.

While the present invention has been particularly shown and described with reference to exemplary embodiments thereof, it will be understood by those of ordinary skill in the art that various changes in form and details may be made therein without departing from the spirit and scope of the present invention as defined by the following claims.

The invention claimed is:

1. A container structure comprising:

a container in which a content is contained, in which a flange extending outwards is formed on an upper end of the container, and in which a locking unit is formed on an inner circumference of the container, and a sealing cap that is combined with the locking unit and seals the container to be able to be opened and closed, an edge portion of the sealing cap being bent to extend downwardly from the sealing cap to form a locking rib, wherein the locking rib can be locked and unlocked to and from the locking unit, wherein the container structure further comprises a lid film that is attached to the entire surface of an upper surface of the sealing cap and an edge portion of the lid film protrudes past the edge portion of the sealing cap around the entire periphery of the sealing cap, and the edge portion of the lid film is heat-sealed onto the flange of the container, wherein the sealing cap comprises bending grooves formed in a lower surface thereof, wherein the lower surface of the sealing cap contacts an upper surface of the content contained in the container, and wherein the bending grooves in contact with the content form cutting guide protrusions on the upper surface of the content.

2. The container structure of claim 1, wherein a combining force between the sealing cap and the lid film is greater than a combining force between the locking unit and the locking rib.

* * * * *